US009530536B2

(12) United States Patent
Fujimoto et al.

(10) Patent No.: US 9,530,536 B2
(45) Date of Patent: Dec. 27, 2016

(54) NON-HALOGEN MULTILAYER INSULATED WIRE AND METHOD FOR PRODUCING THE SAME

(71) Applicant: Hitachi Metals, Ltd., Tokyo (JP)

(72) Inventors: Kenichiro Fujimoto, Hitachi (JP); Mitsuru Hashimoto, Hitachi (JP); Hiroshi Nakashima, Hitachinaka (JP)

(73) Assignee: HITACHI METALS, LTD., Tokyo (JP)

( * ) Notice: Subject to any disclaimer, the term of this patent is extended or adjusted under 35 U.S.C. 154(b) by 65 days.

(21) Appl. No.: 14/059,142

(22) Filed: Oct. 21, 2013

(65) Prior Publication Data

US 2014/0138119 A1 May 22, 2014

(30) Foreign Application Priority Data

Nov. 19, 2012 (JP) ..... 2012-253569

(51) Int. Cl.

| | |
|---|---|
| ***H01B 7/00*** | (2006.01) |
| ***H01B 3/30*** | (2006.01) |
| ***H01B 3/44*** | (2006.01) |
| ***H01B 7/295*** | (2006.01) |
| ***H01B 3/42*** | (2006.01) |

(52) U.S. Cl.

CPC ..... *H01B 3/421* (2013.01); *H01B 3/441* (2013.01)

(58) Field of Classification Search

CPC ..... H01B 3/421; H01B 13/06; H01B 3/441; H01B 3/447; H01B 3/448

USPC ..... 174/110 R, 113 R, 120 R, 120 SR

See application file for complete search history.

(56) References Cited

U.S. PATENT DOCUMENTS 5,525,757 A * 6/1996 O'Brien ..... C08K 3/0058 174/110 SR
2007/0185284 A1 8/2007 Ok et al.
2009/0004472 A1 1/2009 Fujimoto et al.
(Continued)

FOREIGN PATENT DOCUMENTS

CN 1379412 A 11/2002
CN 1969012 A 5/2007
(Continued)

OTHER PUBLICATIONS

ADK-STAB-CDA-1 Data sheet provided (printed May 7, 2015).*
(Continued)

*Primary Examiner* — Chau N Nguyen
*Assistant Examiner* — Roshn Varghese
(74) *Attorney, Agent, or Firm* — McGinn IP Law Group, PLLC.

(57) ABSTRACT

A non-halogen multilayer insulated wire includes a conductor, an inner layer covering the conductor, and an outer layer formed on the external surface of the inner layer. The inner layer includes a polyolefin resin composition including 60 to 95 parts by mass of a high density polyethylene, 5 to 40 parts by mass of an ethylene copolymer, and 0.1 to 1 part by mass of a metal damage inhibitor. The outer layer includes a polyester resin composition that includes a base polymer mainly including a polyester resin, and further includes, relative to 100 parts by mass of the base polymer, 50 to 150 parts by mass of a polyester block copolymer, 0.5 to 5 parts by mass of a hydrolysis inhibitor, 0.5 to 5 parts by mass of an inorganic porous filler, and 10 to 30 parts by mass of magnesium hydroxide.

15 Claims, 3 Drawing Sheets

(56) References Cited

U.S. PATENT DOCUMENTS

| | | | | |
|---|---|---|---|---|
| 2009/0057009 | A1* | 3/2009 | Sato | 174/72 A |
| 2009/0183893 | A1 | 7/2009 | Kambe | |
| 2009/0246434 | A1 | 10/2009 | Miyamoto et al. | |
| 2010/0101824 | A1* | 4/2010 | Fujimoto et al. | 174/110 SR |
| 2010/0101827 | A1 | 4/2010 | Fujimoto et al. | |
| 2012/0289625 | A1* | 11/2012 | Matsuno et al. | 523/451 |
| 2013/0005875 | A1 | 1/2013 | Shoji et al. | |
| 2013/0020107 | A1 | 1/2013 | Pagliuca | |
| 2013/0192871 | A1 | 8/2013 | Nonaka | |
| 2014/0138119 | A1 | 5/2014 | Fujimoto et al. | |

FOREIGN PATENT DOCUMENTS

| | | | | |
|---|---|---|---|---|
| CN | 101171646 | A | | 4/2008 |
| CN | 101724233 | A | | 6/2010 |
| EP | 2 180 017 | A2 | | 4/2010 |
| JP | 2010-97881 | A | | 4/2010 |
| JP | 2010097881 | A | * | 4/2010 |
| JP | 2011-228189 | A | | 11/2011 |
| WO | WO 2006/118254 | A1 | | 11/2006 |

OTHER PUBLICATIONS

English Machine Translation of Segawa (JP 2010-097881) May 7, 2015.*

Japanese Office Action dated Aug. 12, 2014, with English Translation thereof.

European Search Report dated Mar. 31, 2014.

United States Office Action dated Mar. 12, 2015 in co-pending U.S. Appl. No. 14/038,487.

United States Office Action dated Jan. 21, 2016 in U.S. Appl. No. 14/038,487.

English translation of Extended Chinese Search Report dated Dec. 17, 2015.

United States Office Action dated May 13, 2016 in U.S. Appl. No. 14/038,487.

United States Office Action dated Sep. 2, 2016 in U.S. Appl. No. 14/038,487.

Chinese Office Action dated Jun. 23, 2016, and English translation thereof.

Chinese Office Action, dated Jun. 30, 2016, and English translation thereof.

* cited by examiner

NON-HALOGEN MULTILAYER INSULATED WIRE AND METHOD FOR PRODUCING THE SAME

The present application is based on Japanese patent application No. 2012-253569 filed on Nov. 19, 2012, the entire contents of which are incorporated herein by reference.

BACKGROUND OF THE INVENTION

1. Field of the Invention

The present invention relates to non-halogen multilayer insulated wires that are superior in abrasion resistance, hydrolysis resistance, flame retardance, heat resistance and electrical properties (direct current stability) and exhibit low smoke emission and low toxicity, and particularly to a non-halogen multilayer insulated wire complying with European standards (EN standards).

2. Description of the Related Art

Transfer wires and cables used for, for example, railway vehicles and cranes use a halogen-including rubber mixture balanced in terms of oil-fuel resistance, properties at low temperatures, flame retardance, flexibility and cost, such as chloroprene rubber mixture, chlorosulfonyl polyethylene mixture, chlorinated polyethylene mixture, and fluorocarbon rubber mixture.

However, these materials including a large amount of halogen and may release a large amount of toxic, harmful gas, depending on burning conditions, when burning. Accordingly, wires and cables having sheaths that are made of halogen-free material (non-halogen material) not including any halogen are increasingly used from the viewpoint of reducing environmental impact and fire safety.

On the other hand, in Europe, where rail vehicle networks are developed, the regional unified standards called EN standards (European standards) are widely adopted. The EN standards require that halogen-free materials used for wires and cables for railway vehicles be resistant to abrasion, hydrolysis and heat, and exhibit flame retardance, low smoke emission and satisfactory electrical properties (direct current stability) because a defective wire or cable may result in a major accident.

Japanese Unexamined Patent Application Publication No. 2011-228189 is intended to satisfy the requirements of the EN standards. This patent document discloses a multilayer wire including a conductor, an inner layer made of a polyester resin composition including a polyester resin (such as polybutylene terephthalate or polybutylene naphthalate), a polyester block copolymer, a hydrolysis inhibitor and a calcined clay, and an outer layer made of a polyester resin composition including a polyester resin (such as polybutylene terephthalate or polybutylene naphthalate), a polyester block copolymer, a hydrolysis inhibitor, a calcined clay and magnesium hydroxide. The conductor is covered with the inner and outer layers. Each of the polyester block copolymers includes: (a) 20% to 70% by mass of a hard segment mainly including polybutylene terephthalate including 60% by mole or more of terephthalic acid relative to the total number of moles of the dicarboxylic acid component, and (b) 30% to 80% by mass of a soft segment including a polyester including 90% to 99% by mole of an aromatic dicarboxylic acid as the acid component, 1% to 10% by mole of linear aliphatic dicarboxylic acid having a carbon number of 6 to 12, and a linear diol having a carbon number of 6 to 12 as the diol component. The melting point (T) of the polyester block copolymer satisfies the relationship: TO−5>T>TO−60, wherein TO represents the melting point of the polymer including the components of the hard segment.

The EN standards require that the wires and cables one less toxic, in addition to the above characteristics. However, known techniques, including the above cited Japanese Unexamined Patent Application Publication No. 2011-228189, have not been able to produce a wire or cable satisfying all the specifications of the EN standards.

SUMMARY OF THE INVENTION

In view of the foregoing and other exemplary problems, drawbacks, and disadvantages of the conventional methods and structures, an exemplary feature of the present invention is to provide a non-halogen multilayer insulated wire. Accordingly, it is an object of the present invention to provide a non-halogen multilayer insulated wire that may be superior in abrasion resistance, hydrolysis resistance, flame retardance, heat resistance and electrical properties (direct current stability) and exhibits low smoke emission and low toxicity, and particularly to provide a non-halogen multilayer insulated wire may comply with European standards (EN standards).

According to an exemplary aspect of the present invention, a non-halogen multilayer insulated wire is provided.

The non-halogen multilayer insulated wire includes a conductor, an inner layer covering the conductor, and an outer layer disposed over the external surface of the inner layer. The inner layer may include a polyolefin resin composition including 60 to 95 parts by mass of a high density polyethylene, 5 to 40 parts by mass of an ethylene copolymer, and 0.1 to 1 part by mass of a metal damage inhibitor. The outer layer may include a polyester resin composition that includes a base polymer mainly including a polyester resin, and further includes, relative to 100 parts by mass of the base polymer, 50 to 150 parts by mass of a polyester block copolymer, 0.5 to 5 parts by mass of a hydrolysis inhibitor, 0.5 to 5 parts by mass of an inorganic porous filler, and 10 to 30 parts by mass of magnesium hydroxide.

In the above exemplary invention, many exemplary modifications and changes can be made as described below (the following exemplary modifications and changes can be made) However if should be noted that the present invention should in no way be limited to the modifications and changes described below.

The ethylene copolymer may be selected from the group consisting of ethylene-ethylene acrylate copolymer including 9% to 35% by mass of ethyl acrylate, ethylene-vinyl acetate copolymer including 15% to 45% by mass of vinyl acetate, and ethylene-glycidyl methacrylate copolymer.

The metal damage inhibitor may be a copper damage inhibitor including at least one compound selected from the group consisting of hydrazine derivatives and salicylic acid derivatives.

The polyester resin of the base polymer may be polybutylene naphthalate or polybutylene terephthalate.

The hydrolysis inhibitor may be an additive having a carbodiimide skeleton.

The inorganic porous filler may be a calcined clay.

The inner layer and the outer layer may define an insulation having a thickness of 0.1 to 0.5 mm.

According to another exemplary aspect of the invention, a method of forming a non-halogen multilayer insulated wire, the method comprising: forming an inner layer covering a conductor the inner layer comprising a polyolefin resin composition including 60 to 95 parts by mass of a high density polyethylene, 5 to 40 parts by mass of an ethylene copolymer, and 0.1 to 1 part by mass of a metal damage inhibitor; and forming an outer layer covering the inner layer, the outer layer formed on an external surface of the inner layer, the outer layer comprising a polyester resin composition that includes a base polymer mainly including a polyester resin and further includes, relative to 100 parts by mass of the base polymer, 50 to 150 parts by mass of a polyester block copolymer, 0.5 to 5 parts by mass of a hydrolysis inhibitor, 0.5 to 5 parts by mass of an inorganic porous filler, and 10 to 30 parts by mass of magnesium hydroxide.

The above exemplary modifications may be alone or in any combination thereof.

Embodiments of the invention can provide a non-halogen multilayer insulated wire that complies with EN standards, and is superior in abrasion resistance, hydrolysis resistance, flame retardance, heat resistance and electrical properties (direct current stability) and exhibits low smoke emission and low toxicity.

BRIEF DESCRIPTION OF THE DRAWINGS

The foregoing and other exemplary purposes, aspects and advantages will be better understood from the following detailed description of the invention with reference to the drawings, in which.

DESCRIPTION OF THE EXEMPLARY EMBODIMENTS

Figure 1:
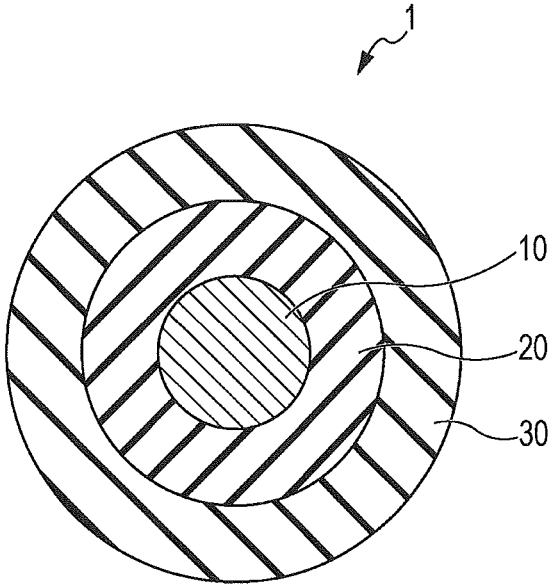
FIG. 1 is a sectional view of a non-halogen multilayer insulated wire 1 according to an embodiment of the present invention.
Figure 2A:
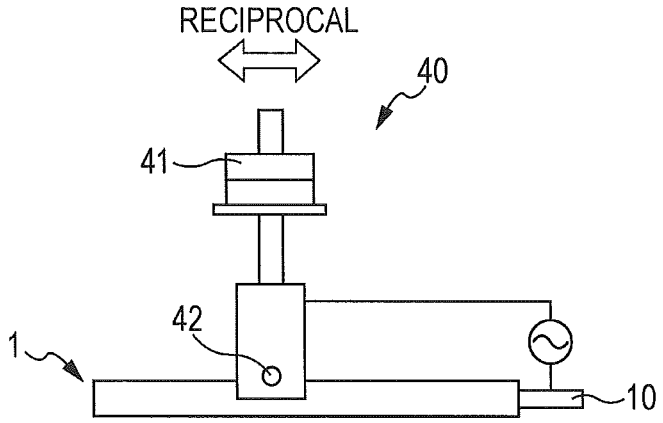
FIG. 2A is a sectional view illustrating a method for examining the abrasion resistance of the wires of the Examples.
Figure 2B:
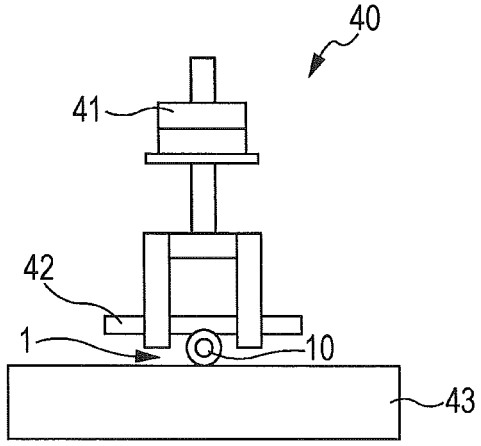
FIG. 2B is a front view of the method.
Figure 3:
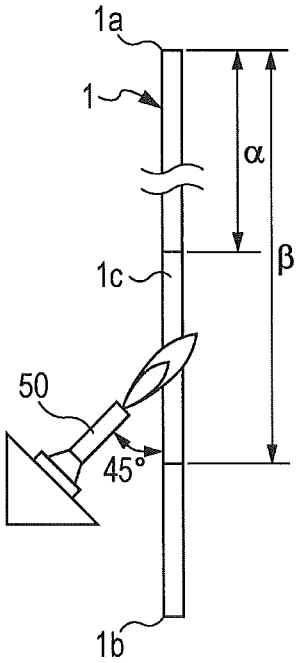
FIG. 3 is a representation illustrating a method for examining the flame retardance of the wires of the Examples.

Referring now to the drawings, and more particularly to FIGS. 1-3, there are shown exemplary embodiments of the methods and structures according to the present invention.

Although the invention has been described with respect to specific exemplary embodiments for complete and clear disclosure, the appended claims are not to be thus limited but are to be construed as embodying all modifications and alternative constructions that may occur to one skilled in the art which fairly fall within the basic teaching herein set forth.

Further, it is noted that Applicant's intent is to encompass equivalents of all claim elements, even if amended later during prosecution.

Structure of Non-Halogen Multilayer Insulated Wire

FIG. 1 is a sectional view of a non-halogen multilayer insulated wire according to an embodiment of the present invention.

As shown in FIG. 1, the non-halogen multilayer insulated wire 1 includes a conductor 10, an inner layer 20 covering the conductor 10, and an outer layer 30 disposed over the external surface of the inner layer 20. The inner layer 20 may include a polyolefin resin composition including 60 to 95 parts by mass of a high density polyethylene, 5 to 40 parts by mass of an ethylene copolymer, and 0.1 to 1 part by mass of a metal damage inhibitor. The outer layer 30 may include a polyester resin composition that includes a base polymer mainly including a polyester resin, and further includes, relative to 100 parts by mass of the base polymer, 50 to 150 parts by mass of a polyester block copolymer, 0.5 to 5 parts by mass of a hydrolysis inhibitor, 0.5 to 5 parts by mass of an inorganic porous filler, and 10 to 30 parts by mass of magnesium hydroxide.

The conductor 10 can be selected from conductors generally used in insulated wires.

The inner layer 20 will be described below. The polyolefin resin composition used for the inner layer 20 may include 60 to 95 parts by mass of a high density polyethylene, 5 to 40 parts by mass of an ethylene copolymer, and 0.1 to 1 part by mass of a metal damage inhibitor.

High Density Polyethylene

The high density polyethylene has a density of preferably, but not limited to, 0.942 g/cm$^3$ or more. The content of the high density polyethylene is in the range of 60 to 95 parts by mass. Preferably, the high density polyethylene content is 60 to 90 parts by mass, more preferably 60 to 80 parts by mass, and still more preferably 60 to 70 parts by mass.

Ethylene Copolymer

Ethylene copolymers that can be used in the present embodiment include ethylene-ethyl acrylate copolymer (EEA), ethylene-vinylacetate copolymer (EVA), ethylene-styrene copolymer, ethylene-glycidyl methacrylate copolymer, ethylene-butene-1 copolymer, ethylene-butene-hexene terpolymer, ethylene-propylene-diene terpolymer (EPDM), ethylene-octene copolymer (EOR), ethylene-copolymerized polypropylene, ethylene-propylene rubber (EPR), poly-4-methyl-pentene-1, maleic acid-grafted low density polyethylene, hydrogenated styrene-butadiene copolymer (H-SER), maleic acid-grafted linear low density polyethylene, ethylene copolymer with α-olefin having a carbon number of 4 to 20, maleic acid-grafted ethylene-methyl acrylate copolymer, maleic acid-grafted ethylene-vinyl acetate copolymer, ethylene-maleic anhydride copolymer, ethylene-ethyl acrylate maleic anhydride terpolymer, and butene-1-based ethylene-propylene-butene-1 terpolymer. Preferably, EEA, EVA or ethylene-glycidyl methacrylate copolymer is used. More preferably, EEA or EVA is used. Ethylene copolymers may be used singly or in combination. The content of the ethylene copolymer is in the range of 5 to 40 parts by mass. Preferably, the ethylene copolymer content is 10 to 40 parts by mass, and more preferably 10 to 30 parts by mass.

Preferably, the EEA includes 9% to 35% by mass of ethyl acrylate in view of flame retardance and mechanical properties. Also, the EVA preferably includes 15% to 45% by mass of vinyl acetate (VA) in view of flame retardance and mechanical properties.

Metal Damage Inhibitor

The metal damage inhibitor stabilizes metal ions by chelation, thus suppressing oxidation degradation. The metal damage inhibitor can be, but is not limited to, a copper damage inhibitor. The copper damage inhibitor can be at least one compound selected from the group consisting of hydrazine derivatives and salicylic acid derivatives. For example, the copper damage inhibitor may be 1,2-bis[(3-(4-hydroxy-3,5-di-tert-butylphenyl)propionyl)]hydrazine (commercially available as IRGANOX (registered trademark) MD 1024)). The metal damage inhibitor content is in the range of 0.1 to 1 part by mass. Preferably, the metal damage inhibitor content is 0.3 to 1 part by mass, and more preferably 0.5 to 1 part by mass. If the metal damage inhibitor content is less than 0.1 part by mass, then the metal damage inhibitor cannot suppress damage from a metal effectively. If it is more than 1 part by mass, then the metal damage inhibitor cannot disperse sufficiently, which is likely to cause degradation of mechanical properties.

The outer layer 30 will now be described. The polyester resin composition used in the outer layer 30 includes a base polymer mainly including a polyester resin, and further includes, relative to 100 parts by mass of the base polymer, 50 to 150 parts by mass of a polyester block copolymer, 0.5 to 5 parts by mass of a hydrolysis inhibitor, 0.5 to 5 parts by mass of an inorganic porous filler, and 10 to 30 parts by mass of magnesium hydroxide.

The phrase "base polymer mainly including a polyester resin" should be understood to mean that the content of the polyester resin is the largest in the base polymer. More specifically, the polyester resin content in the base polymer is greater than or equal to 50% by mass. Preferably, the polyester resin content is 70% by mass or more, more preferably 80% by mass or more, and still more preferably 90% by mass or more. Polyester resin is superior in heat resistance and abrasion resistance, and is accordingly used in the present embodiment.

Polyester Resin

Examples of the polyester resin include polybutylene naphthalate resin (PBN), polybutylene terephthalate resin (PBT), polytrimethylene terephthalate resin, polyethylene napthalate resin, and polyethylene terephthalate resin. These polyester resins can be used in combination to the extent that the advantages of the invention are not lost. Polybutylene naphthalate resin and polybutylene terephthalate resin will be described in detail by way of example.

The polybutylene naphthalate resin used in the present embodiment is a polyester including an acid component mainly including naphthalene dicarboxylic acid, preferably naphthalene-2,6-dicarboxylic acid, and a glycol component mainly including 1,4-butanediol. In other words, all or most (generally 90% by mole or more, preferably 95% by mole or more) of the repeating unit of the polybutylene naphthalate is butylene naphthalene dicarboxylate.

The polybutylene naphthalate resin may be copolymerized with the following components as long as its physical properties are not degraded.

Acid components other than naphthalene dicarboxylic acid may be copolymerized, including aromatic dicarboxylic acids such as phthalic acid, isophthalic acid, terephthalic acid, diphenyldicarboxylic acid, diphenyletherdicarboxylic acid, diphenoxyethanedicarboxylic acid, diphenylmethanedicarboxylic acid, diphenylketonedicarboxylic acid, diphenylsulfidedicarboxylic acid, and diphenylsulfonedicarboxylic acid; aliphatic dicarboxylic acids, such as succinic acid, adipic acid, and sebacic acid; and alicyclic dicarboxylic acids, such as cyclohexanedicarboxylic acid, tetralindicarboxylic acid, and decalindicarboxylic acid.

A glycol component may be copolymerized, such as ethylene glycol, propylene glycol, trimethylene glycol, pentamethylene glycol, hexamethylene glycol, octamethylene glycol, neopentyl glycol, cyclohexanedimethanol, xylylene glycol, diethylene glycol, polyethylene glycol, bisphenol A, catechol, resorcinol, hydroquinone, dihydroxydiphenyl, dihydroxydiphenyl ether, hydroquinone, dihydroxydiphenyl, dihydroxydiphenyl ether, dihydroxydiphenylmethane, dihydroxydiphenyl ketone, dihydroxydiphenylsulfide, and dihydroxydiphenyl sulfone.

An oxycarboxylic acid component may be copolymerized, such as oxybenzoic acid, hydroxynaphthoic acid, hydroxydiphenylcarboxylic acid, and co-hydroxycaproic acid.

The polyester may be copolymerized with trifunctional or more highly functional compounds such glycerol, trimethylpropane, pentaerythritol, trimellitic acid, and pyromellitic acid, as long as the polyester substantially maintain its moldability.

In the present embodiment, the terminal carboxyl group content of the polybutylene naphthalate resin is not particularly limited, but is preferably low.

The polybutylene naphthalate resin is prepared by polycondensation of a naphthalenedicarboxylic acid and/or its functional derivative and butylene glycol and/or its functional derivative, in a known aromatic polyester synthesis.

The polybutylene terephthalate resin used in the present embodiment is a polyester having a butylene terephthalate repeating unit as the main component. The butylene terephthalate repeating unit is formed of 1,4-butanediol as a polyhydric alcohol component and terephthalic acid or its ester-forming derivative as a polyvalent carboxylic acid component. The repeating unit as the main component implies that the butylene terephthalate unit accounts for 70% by mole or more of all the polyvalent carboxylic acid-polyhydric alcohol units. Preferably, the butylene terephthalate unit accounts for 80% by mole or more, more preferably 90% by mole or more, and still more preferably 95% by mole or more.

Polyvalent carboxylic acid components other than terephthalic acid, used for the polybutylene terephthalate resin include aromatic polyvalent carboxylic acids, such as 2,6-naphthalenedicarboxylic acid, 2,7-naphthalenedicarboxylic acid, isophthalic acid, phthalic acid, trimesic acid, and trimellitic acid; aliphatic dicarboxylic acids, such as oxalic acid, malonic acid, succinic acid, glutaric acid, adipic acid, suberic acid, azelaic acid, sebacic acid, and decanedicarboxylic acid; alicyclic dicarboxylic acids, such as cyclohexanedicarboxylic acid; and ester-forming derivatives of these polyvalent carboxylic acids (for example, lower alkyl esters of polyvalent carboxylic acids, such as dimethyl terephthalate). These polyvalent carboxylic acid components other than terephthalic acid may be used singly or in combination.

Polyhydric alcohol components other than 1,4-butanediol, used in the polybutylene terephthalate resin include aliphatic polyhydric alcohols, such as ethylene glycol, diethylene glycol, propylene glycol, neopentyl glycol, pentanediol, hexanediol, glycerol, trimethylolpropane, and pentaerythritol; alicyclic polyhydric alcohols, such as 1,4-cyclohexanedimethanol; aromatic polyhydric alcohols, such as bisphenol A and bisphenol Z; and polyalkylene glycol, such as polyethylene glycol, polypropylene glycol, polytetramethylene glycol, and polytetramethyleneoxide glycol. These polyhydric alcohol components other than 1,4-butanediol may be used singly or in combination.

In view of hydrolysis resistance, the terminal carboxyl group content in the polybutylene terephthalate resin is preferably 50 equivalents per ton (hereinafter represented by eq/t) or less, more preferably 40 eq/t or less, and still more preferably 30 eq/t or less. A polybutylene terephthalate resin including more than 50 eq/t of terminal carboxyl group is unsuitable in view of hydrolysis resistance.

The polybutylene terephthalate resin may be composed of a single polybutylene terephthalate, or may be a mixture of different polybutylene terephthalates varying in terminal carboxyl group content, melting point, amount of catalyst required, or any other factor.

Polyester Block Copolymer

The polyester resin composition used in the outer layer 30 may include a polyester block copolymer. The polyester block copolymer may be added to enhance the heat resistance and to impart flexibility.

To 100 parts by mass of the base polymer, 100 to 150 parts by mass of a polyester block copolymer is added. More preferably, the amount of polyester block copolymer to be added is 60 to 100 parts by mass. If the amount of polyester block copolymer is less than 50 parts by mass, then heat resistance is degraded. In contrast, if the amount exceeds 150 parts by mass, then the elastic modulus of the material of the outer layer 30 is reduced, and the mechanical properties, particularly abrasion resistance, of the outer layer 30 are considerably degraded.

The polyester block copolymer includes a hard segment including 60% by mole or more (preferably 70% by mole or more) of polybutylene terephthalate. The hard segment may have been copolymerized with an aromatic dicarboxylic acid, other than terephthalic acid, having a benzene or naphthalene ring, an aliphatic dicarboxylic acid having a carbon number of 4 to 12, an aliphatic diol, other than tetramethylene glycol, having a carbon number of 2 to 12, or an alicyclic diol such as cyclohexanedimethanol, in a proportion of less than 30% by mole, preferably less than 10% by mole, relative to the total amount of the dicarboxylic acids. It is preferable that the content of such polymerization component be low because a lower content results in a higher melting point. However, copolymerization of the hard segment is performed to enhance the flexibility. Unfortunately, if the content of copolymerization component is increased, then the compatibility of the polyester block copolymer with polybutylene naphthalate is reduced and may result in degraded abrasion resistance.

The polyester block copolymer also includes a soft segment that is a polyester including 90% to 99% by mole of an aromatic dicarboxylic acid, and 1% to 10% by mole of linear aliphatic dicarboxylic acid having a carbon number of 6 to 12, and whose diol component is a linear diol having a carbon number of 6 to 12. Examples of the aromatic dicarboxylic acid include terephthalic acid and isophthalic acid. Examples of the linear aliphatic dicarboxylic acid having a carbon number of 6 to 12 include adipic acid and sebacic acid. The linear aliphatic dicarboxylic acid content is preferably 1% to 10% by mole, more preferably 2% to 5% by mole, relative to the total acid component of the polyester in the soft segment. If the linear aliphatic dicarboxylic acid content is 10% by mole or more, then the compatibility of the polyester block copolymer with polybutylene naphthalate is degraded. In contrast, if it is 1% by mole or less, then the flexibility of the soft segment is degraded and, consequently, the softness of the polyester resin composition is degraded.

The polyester constituting the soft segment should be amorphous or have low crystallinity. Accordingly, isophthalic acid is preferably used in a proportion of 20% by mole or more to the total acid component of the soft segment. As with the hard segment, the soft segment may be copolymerized with a small amount of other components. However, this copolymerization leads to degraded compatibility with polybutylene naphthalate. Accordingly, the amount of copolymerization component is preferably 10% by mole or less, and more preferably 5% by mole or less.

In the polyester block copolymer used in the present embodiment, the mass ratio of the hard segment to the soft segment is preferably in the range of 20:80 to 50:50, and more preferably in the range of 25:75 to 40:60. If the proportion of the hard segment is higher than the above ranges, then the resulting material is likely to be too hard to use. If the proportion of the soft segment is higher than the above ranges, then the resulting material is degraded in crystallinity and is likely to be difficult to handle.

The lengths of the soft and hard segments of the polyester block copolymer are preferably, but are not limited to, about 500 to 7000, more preferably about 800 to 5000, in terms of molecular weight. Although the lengths of these segments cannot be directly measured, they may be estimated using the Flory equation using the compositions of the polyesters defined by the soft segment or the hard segment, the melting point of the polyester of the hard segment, and the melting point of the resulting polyester block copolymer.

The melting point (T) of the polyester block copolymer is preferably in the range of "TO−5>T>TO−60", wherein TO represents the melting point of a polymer defined by the hard segment component. More specifically, the melting point (T) is preferably between TO−5 and TO−60, more preferably between TO−10 and TO−50, and still more preferably between TO−15 and TO−40.

The melting point (T) is greater than the melting point of a comparable random copolymer by 10° C. or more, preferably 20° C. or more. If the melting point of the random copolymer is not determined, then the melting point (T) may be set to 150° C. or more, preferably 160° C. or more.

Comparable polyester random copolymers, which are generally amorphous and in a starch syrup state and have low glass transition temperature, are difficult to handle in practice because of their inferior moldability or sticky surface, even if they are used instead of the polyester block copolymer.

The intrinsic viscosity of the polyester block copolymer measured at 35° C. in o-chlorophenol is preferably 0.6 or more, and more preferably 0.8 to 1.5. A polyester block copolymer having an intrinsic viscosity lower than the above range disadvantageously exhibits a low strength.

In a synthesis process of the polyester block copolymer, for example, polymers defining the soft segment and the hard segment are prepared separately, and these polyesters are melt-blended so that the polyester block copolymer has a lower melting point than the polyester defining the hard segment. Since the melting point of the polyester block copolymer varies with mixing temperature and mixing time, it is preferable that a deactivator of the catalyst, such as phosphorus oxyacid, be added to deactivate the catalyst, when entering a state where the reaction system exhibits a desired melting point.

Hydrolysis Inhibitor

The polyester resin composition used in the outer layer 30 may further include a hydrolysis inhibitor. Examples of the hydrolysis inhibitor include, but are not limited to, compounds having carbodiimide skeletons, such as dicyclohexylcarbodiimide, diisopropylcarbodiimide, and 1-ethyl-3-(3-dimethylaminopropyl)carbodiimide hydrochloric acid salt.

The hydrolysis inhibitor content is 0.5 to 5 parts by mass, preferably 0.5 to 4 parts by mass, more preferably 0.5 to 3 parts by mass, still more preferably 0.5 to 2 parts by mass, relative to 100 parts by mass of the base polymer. With a content of less than 0.5 part by mass, the hydrolysis inhibitor cannot function sufficiently to inhibit hydrolysis. In contrast, a hydrolysis inhibitor having a content of more than 5 parts by mass cannot achieve low toxicity.

Inorganic Porous Filler

The polyester resin composition used in the outer layer 30 may further include an inorganic porous filler. The inorganic porous filler is added to enhance the electrical properties of the outer layer 30.

The inorganic porous filler content is 0.5 to 5 parts by mass, preferably 0.5 to 3 parts by mass, more preferably 0.5 to 2 parts by mass, still more preferably 0.5 to 1 part by mass, relative to 100 parts by mass of the base polymer.

Since an excessively small amount of inorganic porous filler cannot sufficiently trap ions and results in reduced insulation resistance or degraded electrical properties. In contrast, an excessively large amount of inorganic porous filler undesirably leads to degraded abrasion resistance.

The inorganic porous filler used in the present embodiment preferably has a specific surface area of 5 $m^2/g$ or more.

The inorganic porous filler is preferably, but not limited to, calcined clay, and may be zeolite, Mesalite, anthracite, foamed perlite or active carbon. The inorganic porous filler may be surface-treated with, for example, silane or fatty acid.

Magnesium Hydroxide

The polyester resin composition used in the outer layer 30 may further include magnesium hydroxide. Magnesium hydroxide is added to enhance flame retardance and impart a property of low smoke emission.

To 100 parts by mass of the base polymer, 10 to 30 parts by mass of magnesium hydroxide is added. A magnesium hydroxide content of less than 10 parts by mass cannot achieve the property of low smoke emission. In contrast, a polyester resin composition having a magnesium hydroxide content of more than 30 parts by mass results in a wire having reduced flexibility and reduced abrasion resistance.

The magnesium hydroxide may be surface-treated with, for example, a fatty acid, a metal salt of a fatty acid, vinyltrimethoxysilane, vinyltriethoxysilane, methacryloxypropyltrimethoxysilane, methacryloxypropyltriethoxysilane, aminopropyltrimethoxysilane or aminopropyltriethoxysilane. Untreated magnesium hydroxide may be used.

The resin compositions for the inner layer 20 and the outer layer 30 may each be prepared by a known process in an arbitrary stage before being applied. Most simply, materials such as high density polyethylene, ethylene copolymer and a metal damage inhibitor are melt-blended and then formed into pellets by extrusion, or materials such as polyester resin, polyester block copolymer, a hydrolysis inhibitor, an inorganic porous filler and magnesium hydroxide are melt-blended and then formed into pellets by extrusion.

The resin compositions for the inner layer 20 and the outer layer 30 may each include known additives such as a pigment, a dye, filler, a core agent, a release agent, an antioxidant, a stabilizer, an antistatic agent and a lubricant, within ranges in which advantageous effects of the present invention can be produced.

In the manufacture of the multilayer insulated wire 1 of the present embodiment, the resin compositions for the inner layer 20 and the outer layer 30 may be applied separately or simultaneously by extrusion. The multilayer insulated wire 1 coated with the inner layer 20 and the outer layer 30 may be subjected to irradiation cross-linking, if necessary.

The insulation of the insulated wire 1, defined by the two layers (inner layer 20 and outer layer 30) preferably has a thickness of 0.1 μm to 0.5 mm. Preferably, the thickness of the inner layer 20 is 0.05 μm to 0.2 mm, and the thickness of the outer layer 30 is 0.05 μm to 0.3 mm.

The insulation of the multilayer insulated wire 1 is not limited to a double-layer structure, as long as including the inner layer 20 and the outer layer 30. For example, an insulating layer may be provided between the conductor 10 and the inner layer 20, or an intermediate layer may be provided between the inner layer 20 and the outer layer 30, as long as advantageous effects of the present invention can be produced.

The present invention will be further described in detail with reference to Examples. The invention is however not limited to the examples.

EXAMPLES

Multilayer insulated wires of Examples 1 to 12 and Comparative Examples 1 to 9 were prepared as below. Compositions of the resins of the inner and outer layers of each multilayer insulated wire sample are shown in Table 1, and the evaluation results are shown in Table 2.

Materials Used

HDPE (high density polyethylene): HI-ZEX (registered trademark) 550P, produced by Prime Polymer Co., Ltd.

EEA (ethylene-ethyl acrylate copolymer): REXPEARL (registered trademark) ERA A1150 (ethyl acrylate content: 15% by mass), produced by Japan Polyethylene Corporation.

EVA (ethylene-vinyl acetate copolymer): Evaflex (registered trademark) EV 260 (vinyl acetate content: 28% by mass), produced by du Pont-Mitsui Polychemical Co., Ltd.

EGMA (ethyleneglycidyl methacrylate): Bond Fast (registered trademark) 2C, produced by Sumitomo Chemical Co., Ltd.

TMPTMA (trimethylolpropane trimethacrylate): NK Ester TMPT (H-200), produced by Shin-Nakamura Chemical Co., Ltd.

Metal damage inhibitor (copper damage inhibitor, 1,2-bis [3-(4-hydroxy-3,5-di-tert-butylphenyl)propionyl)]hydrazine): IRGANOX (registered trademark) MD 1024, produced by BASF Antioxidant: ADK STAB (registered trademark) AO-18, produced by ADEKA Corporation PBN (polybutylene naphthalate resin): TQB-OT, produced by Teijin Limited PBT (polybutylene terephthalate resin): NOVADURAN (registered trademark) 5026, produced by Mitsubishi Engineering-Plastics Corporation PEBC (polyester block copolymer): Nouvelan (registered trademark) TRB-EL2, produced by Teijin Limited Hydrolysis inhibitor (polycarbodiimide): CARBODILITE (registered trademark) HMV-8CA, produced by Nisshinbo Chemical Inc.

Calcined clay (surface-treated calcined kaolin): SATINTONE (registered trademark) SP-33, produced by Engelhard Corporation Magnesium hydroxide: Kisuma (registered trademark) 5L, produced by Kyowa Chemical Industry Co., Ltd.

TABLE 1

| | Constituent (parts by mass) | | | | | | | | | | | | |
|---|---|---|---|---|---|---|---|---|---|---|---|---|---|
| | Inner layer polyolefin resin composition A | | | | | | | Outer layer polyester resin composition B | | | | | |
| | HDPE | EEA | EVA | EGMA | Metal damage inhibitor | TMPTMA | Antioxidant | PBN | PBT | PEBC | Hydrolysis inhibitor | Calcined clay | Magnesium hydroxide |
| Example 1 | 60 | 40 | — | — | 0.5 | 1 | 1.5 | 100 | — | 66.7 | 1 | 1 | 20 |
| Example 2 | 70 | 30 | — | — | 0.5 | 1 | 1.5 | 100 | — | 66.7 | 1 | 1 | 20 |
| Example 3 | 90 | 10 | — | — | 0.5 | 1 | 1.5 | 100 | — | 66.7 | 1 | 1 | 20 |
| Example 4 | 70 | — | 30 | — | 0.5 | 1 | 1.5 | 100 | — | 66.7 | 1 | 1 | 20 |
| Example 5 | 70 | 20 | — | 10 | 0.5 | 1 | 1.5 | 100 | — | 66.7 | 1 | 1 | 20 |
| Example 6 | 70 | 30 | — | — | 0.5 | 1 | 1.5 | — | 100 | 66.7 | 1 | 1 | 20 |
| Example 7 | 70 | 30 | — | — | 0.5 | 1 | 1.5 | 100 | — | 120 | 1 | 1 | 20 |
| Example 8 | 70 | 30 | — | — | 0.5 | 1 | 1.5 | 100 | — | 66.7 | 1 | 1 | 10 |
| Example 9 | 70 | 30 | — | — | 0.5 | 1 | 1.5 | 100 | — | 66.7 | 1 | 1 | 30 |
| Example 10 | 70 | 30 | — | — | 0.1 | 1 | 1.5 | 100 | — | 66.7 | 1 | 1 | 20 |
| Example 11 | 70 | 30 | — | — | 1 | 1 | 1.5 | 100 | — | 66.7 | 1 | 1 | 20 |
| Example 12 | 70 | 30 | — | — | 0.5 | 1 | 1.5 | 100 | — | 66.7 | 1 | 5 | 20 |
| Comparative Example 1 | 100 | — | — | — | 0.5 | 1 | 1.5 | 100 | — | 66.7 | 1 | 1 | 20 |
| Comparative Example 2 | 50 | 50 | — | — | 0.5 | 1 | 1.5 | 100 | — | 66.7 | 1 | 1 | 20 |
| Comparative Example 3 | 70 | 30 | — | — | 0.5 | 1 | 1.5 | 100 | — | 180 | 1 | 1 | 20 |
| Comparative Example 4 | 70 | 30 | — | — | 0.5 | 1 | 1.5 | 100 | — | 30 | 1 | 1 | 20 |
| Comparative Example 5 | 70 | 30 | — | — | 0.5 | 1 | 1.5 | 100 | — | 66.7 | 8 | 1 | 20 |
| Comparative Example 6 | 70 | 30 | — | — | 0.5 | 1 | 1.5 | 100 | — | 66.7 | 1 | 10 | 20 |
| Comparative Example 7 | 70 | 30 | — | — | 0.5 | 1 | 1.5 | 100 | — | 66.7 | 1 | 1 | 5 |
| Comparative Example 8 | 70 | 30 | — | — | 0.5 | 1 | 1.5 | 100 | — | 66.7 | 1 | 1 | 40 |
| Comparative Example 9 | 70 | 30 | — | — | — | 1 | 1.5 | 100 | — | 66.7 | 1 | 1 | 20 |

Preparation of Multilayer Insulated Wire

The resulting resin compositions A and B were dried in a hot air thermostatic chamber respectively at 80° C. for 8 hours or more and at 120° C. for 8 hours or more. Resin composition A was extruded directly onto a tin-plated annealed copper wire of about 0.9 mm in diameter to form a coating of 0.10 mm in thickness, and then resin composition B was further extruded to a thickness of 0.15 mm on the periphery of the coating of resin composition A. Thus, multilayer insulated wires of Examples and Comparative Examples were prepared. For the extrusion, dice having diameters of 4.2 mm and 2.0 mm and a nipple were used. Resin composition A was extruded through a cylinder at a temperature of 150 to 170° C. and a head at a temperature of 170° C., and resin composition B was extruded through a cylinder at a temperature of 250 to 280° C. and a head at a temperature of 270° C. The take-up rate was 10 m/min. The multilayer insulated wires were subjected to irradiation cross-linking, thus being completed.

The multilayer insulated wires were evaluated as below for abrasion resistance, hydrolysis resistance, flame retardance, heat resistance, smoke emission, direct current stability, and toxicity.

Abrasion Resistance Test

As shown in FIGS. 2A and 2B, the prepared multilayer insulated wire 1 placed on a testing table 43 was reciprocally moved with a load of 7 N applied with an abrasion indenter 42 of an abrasion tester 40, and the number of times of reciprocal movement was counted until short circuit occurred in the wire 1. The load was controlled with weights 41. When the number of times of reciprocal movement was 150 or more, the test sample was determined to be good. When it was less than 150, the sample was determined to be bad.

Hydrolysis Resistance Test

The multilayer insulated wire 1 from which the conductor 10 had been removed was allowed to stand in a 85° C./85% RH constant temperature and humidity chamber for 30 days. Then, the sample was wound around itself. Samples that exhibited no breakage were determined to be good, and samples that exhibited breakage were determined to be bad.

Flame Retardance Test

The prepared multilayer insulated wire 1 was subjected to flame retardance test in accordance with IEC flame test (IEC 60332-1). As shown in FIG. 3, the multilayer insulated wire 1 was held in a vertical position at the upper held portion 1*a* and lower held portion 1*b*, and a flame was applied at an angle of 45° with a burner 50 to the wire 1 at a position 475±5 mm from the upper held portion 1*a* for a predetermined time. Then, the burner 50 was removed to extinguish the flame, and the carbonized portion 1*c* was examined. When the length α from the upper held portion 1*a* to the upper position of the carbonized portion 1*c* was 50 mm or more and the length β from the upper held portion 1*a* to the lower position of the carbonized portion 1*c* was 540 mm or less, the sample was determined to be good. When length α and/or length β was outside these ranges, the sample was determined to be bad.

Heat Resistance Test

For evaluating the heat resistance of the wire samples, the following heat aging test was performed. The wire sample wound around a mandrel was heat-treated at 175° C. for 168 hours in accordance with EN 50305 7.7. Then, the sample was allowed to stand at room temperature, and was wound around a mandrel having a diameter twice as large as the outer diameter of the sample. When the insulation exhibited no breakage was determined to be good. When the insulation exhibited breakage was determined to be bad.

Comprehensive Evaluation

Samples determined to be good in all the tests of abrasion resistance, hydrolysis resistance, flame retardance, heat resistance, smoke emission, electrical property (direct current stability) and toxicity passed the comprehensive evaluation, and samples determined to be bad in any one of the tests failed the comprehensive evaluation.

TABLE 2

| | Abrasion resistance | Hydrolysis resistance | Flame retardance | Heat resistance | Smoke emission | DC stability | Toxicity | Comprehensive evaluation |
|---|---|---|---|---|---|---|---|---|
| Example 1 | Good | Good | Good | Good | Good | Good | Good | Passed |
| Example 2 | Good | Good | Good | Good | Good | Good | Good | Passed |
| Example 3 | Good | Good | Good | Good | Good | Good | Good | Passed |
| Example 4 | Good | Good | Good | Good | Good | Good | Good | Passed |
| Example 5 | Good | Good | Good | Good | Good | Good | Good | Passed |
| Example 6 | Good | Good | Good | Good | Good | Good | Good | Passed |
| Example 7 | Good | Good | Good | Good | Good | Good | Good | Passed |
| Example 8 | Good | Good | Good | Good | Good | Good | Good | Passed |
| Example 9 | Good | Good | Good | Good | Good | Good | Good | Passed |
| Example 10 | Good | Good | Good | Good | Good | Good | Good | Passed |
| Example 11 | Good | Good | Good | Good | Good | Good | Good | Passed |
| Example 12 | Good | Good | Good | Good | Good | Good | Good | Passed |
| Comparative Example 1 | Good | Good | Bad | Good | Good | Good | Good | Failed |
| Comparative Example 2 | Bad | Good | Good | Good | Good | Bad | Good | Failed |
| Comparative Example 3 | Bad | Good | Good | Good | Good | Good | Good | Failed |
| Comparative Example 4 | Good | Good | Good | Bad | Good | Good | Good | Failed |
| Comparative Example 5 | Good | Good | Good | Good | Good | Good | Bad | Failed |
| Comparative Example 6 | Bad | Good | Good | Bad | Good | Good | Good | Failed |
| Comparative Example 7 | Good | Good | Bad | Good | Bad | Good | Bad | Failed |
| Comparative Example 8 | Bad | Good | Good | Bad | Good | Good | Good | Failed |
| Comparative Example 9 | Good | Good | Good | Bad | Good | Good | Good | Failed |

Smoke Emission Density Test

In accordance with EN 61034-2 (EN 50268-2), the wire sample was cut into 1 m long pieces, and 10 strands each made of 7 pieces of the wire sample were prepared. The strands were burned with an alcohol fuel. The transmittance of the smoke generated by the burning was measured. When the transmittance of the smoke was 70% or more, the sample was determined to be good. When the transmittance was less than 70%, the sample was determined to be bad.

Electrical Property (Direct Current Stability) Test

A DC of 300 V was applied to the wire sample in 3% NaCl aqueous solution of 85° C. in accordance with EN 50305 6.7. After continuing the DC application for 10 days, samples exhibiting no dielectric breakdown were determined to be good, and samples exhibiting dielectric breakdown were determined to be bad.

Toxicity Test

In accordance with EN 50305 9.2, the conductor 10 was removed from the multilayer insulated wire 1, and the rest of the wire 1, or the inner layer 20 and the outer layer 30, was cut in round slices. One gram of the slices was burned at 800° C. Five gases (CO, $CO_2$, HCN, $SO_2$, $NO_x$) generated by the burning were subjected to quantitative analysis, and the toxicity index (ITC value) of the wire 1 was calculated from the results of the quantitative analysis with predetermined weighting. Samples having ITC values of 6 or less were determined to be good, and samples having TIC values of more than 6 were determined to be bad.

Table 2 shows that the samples of Examples 1 to 12, which are within the scope of the present invention, were superior in abrasion resistance, hydrolysis resistance, flame retardance, heat resistance and direct current stability, and exhibited low smoke emission and low toxicity.

On the other hand, the sample of Comparative Example 1, in which the inner layer did not include ethylene copolymer, exhibited insufficient flame retardance and thus was not satisfactory. In Comparative Example 2, the ethylene copolymer content in the inner layer was higher than the range specified in an embodiment of the present invention. Accordingly, the abrasion resistance and direct current stability were not satisfactory.

In Comparative Example 3, the polyester block copolymer content in the outer layer was higher than the range specified in an embodiment of the present invention. Accordingly, the abrasion resistance was not satisfactory. In Comparative Example 4, the polyester block copolymer content in the outer layer was lower than the range specified in an embodiment of the present invention. Accordingly, the heat resistance was not satisfactory.

In Comparative Example 5, the polyester hydrolysis inhibitor content in the outer layer was higher than the range specified in an embodiment of the present invention. Accordingly, the sample did not exhibit satisfactory characteristics in the toxicity test. In Comparative Example 6, the calcined clay content in the outer layer was higher than the range specified in an embodiment of the present invention. Accordingly, the abrasion resistance and the heat resistance were not satisfactory.

In Comparative Example 7, the magnesium hydroxide content in the outer layer was lower than the range specified in an embodiment of the present invention. Accordingly, the sample did not exhibit satisfactory characteristics in terms of toxicity, flame retardance, and smoke emission. In Comparative Example 8, the magnesium hydroxide content in the outer layer was higher than the range specified in an embodiment of the present invention. Accordingly, the surface of the wire sample was roughed up, and thus the abrasion resistance and the heat resistance were not satisfactory. In Comparative Example 9, the inner layer did not include a metal damage inhibitor. Accordingly, the heat resistance was not satisfactory.

What is claimed is:

1. A non-halogen multilayer insulated wire, comprising:

a conductor;

an inner layer covering the conductor, the inner layer comprising a polyolefin resin composition that includes a polymer consisting of a high density polyethylene, an ethylene-ethyl acrylate copolymer, and a metal damage inhibitor, the polymer including 60 to 95 parts by mass of the high density polyethylene, 5 to 40 parts by mass of an ethylene-ethyl acrylate copolymer, and 0.1 to 1 part by mass of the metal damage inhibitor; and an outer layer formed on an external surface of the inner layer, the outer layer comprising a polyester resin composition includes a base polymer mainly including a polyester resin and further includes, relative to 100 parts by mass of the base polymer, 50 to 150 parts by mass of a polyester block copolymer, 0.5 to 5 parts by mass of a hydrolysis inhibitor, 0.5 to 5 parts by mass of an inorganic porous filler, and 10 to 30 parts by mass of magnesium hydroxide, wherein the polyester resin of the base polymer comprises polybutylene naphthalate or polybutylene terephthalate, and wherein the metal damage inhibitor comprises a copper damage inhibitor including a hydrazine derivative.

2. The non-halogen multilayer insulated wire according to claim 1, wherein the ethylene-ethyl acrylate copolymer includes 9% to 35% by mass of ethyl acrylate.

3. The non-halogen multilayer insulated wire according to claim 1, wherein the hydrolysis inhibitor comprises a carbodiimide skeleton.

4. The non-halogen multilayer insulated wire according to claim 1, wherein the inorganic porous filler comprises a calcined clay.

5. The non-halogen multilayer insulated wire according to claim 1, wherein the inner layer and the outer layer form an insulation having a thickness of 0.1 μM to 0.5 mm.

6. The non-halogen multilayer insulated wire according to claim 1, wherein the metal damage inhibitor comprises 1,2-bis[3-(4-hydroxy-3,5-di-tert-butylphenyl)propionyl)] hydrazine.

7. The non-halogen multilayer insulated wire according to claim 1, wherein a thickness of the inner layer is 0.05 μm to 0.2 mm and a thickness of the outer layer is 0.05 μm to 0.3 mm.

8. The non-halogen multilayer insulated wire according to claim 1, wherein the wire has an abrasion resistance of a number of times of reciprocal movement is counted until short circuit occurred in the wire is 150 or more, after the wire placed on a testing table is reciprocally moved with a load of 9 N applied with an abrasion indenter of an abrasion tester.

9. The non-halogen multilayer insulated wire according to claim 1, wherein there is no breakage on the wire, after the wire from which the conductor is removed is allowed to stand in a 85° C./85% RH constant temperature and a humidity chamber for 30 days, and then, the wire is wound around itself.

10. The non-halogen multilayer insulated wire according to claim 1, wherein the polyolefin resin composition includes 0.5 to 1 part by mass of the metal damage inhibitor.

11. The non-halogen multilayer insulated wire according to claim 1, wherein the polymer includes 60 to 70 parts by mass of the high density polyethylene.

12. The non-halogen multilayer insulated wire according to claim 11, wherein the polymer includes 10 to 30 parts by mass of the ethylene-ethyl acrylate.

13. The non-halogen multilayer insulated wire according to claim 1, wherein the polymer includes 10 to 30 parts by mass of the ethylene-ethyl acrylate.

14. A method of forming a non-halogen multilayer insulated wire, the method comprising:

forming an inner layer covering a conductor, the inner layer comprising a polyolefin resin composition that includes a polymer consisting of a high density polyethylene, an ethylene-ethyl acrylate copolymer, and a metal damage inhibitor, the polymer including 60 to 95 parts by mass of the high density polyethylene, 5 to 40 parts by mass of an ethylene-ethyl acrylate copolymer, and 0.1 to 1 part by mass of the metal damage inhibitor; and forming an outer layer covering the inner layer, the outer layer formed on an external surface of the inner layer, the outer layer comprising a polyester resin composition that includes a base polymer mainly including a polyester resin and further includes, relative to 100 parts by mass of the base polymer, 50 to 150 parts by mass of a polyester block copolymer, 0.5 to 5 parts by mass of a hydrolysis inhibitor, 0.5 to 5 parts by mass of an inorganic porous filler, and 10 to 30 parts by mass of magnesium hydroxide, wherein the polyester resin of the base polymer comprises polybutylene naphthalate or polybutylene terephthalate, and wherein the metal damage inhibitor comprises a copper damage inhibitor including a hydrazine derivative.

15. The method according to claim 14, wherein the metal damage inhibitor comprises 1,2-bis[3-(4-hydroxy-3,5-di-tert-butylphenyl)propionyl)] hydrazine.

* * * * *